US009774933B2

(12) United States Patent
Yeh et al.

(10) Patent No.: US 9,774,933 B2
(45) Date of Patent: Sep. 26, 2017

(54) HOUSING ASSEMBLY AND ELECTRONIC DEVICE USING THE SAME

(71) Applicant: Chiun Mai Communication Systems, Inc., New Taipei (TW)

(72) Inventors: Chien-Feng Yeh, New Taipei (TW); Wei-Jen Chang, New Taipei (TW); Meng-Jer Huang, New Taipei (TW); Chih-Wei Su, New Taipei (TW); Chun-Yen Liu, New Taipei (TW); Chih-Cheng Chang, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 207 days.

(21) Appl. No.: 14/014,600

(22) Filed: Aug. 30, 2013

(65) Prior Publication Data

US 2014/0348368 A1 Nov. 27, 2014

(30) Foreign Application Priority Data

May 23, 2013 (TW) ..... 102209544

(51) Int. Cl.
*H04R 1/02* (2006.01)

(52) U.S. Cl.
CPC ..... *H04R 1/023* (2013.01); *H04R 2499/11* (2013.01)

(58) Field of Classification Search
None
See application file for complete search history.

(56) References Cited

U.S. PATENT DOCUMENTS

| | | | | |
|---|---|---|---|---|
| 4,225,970 | A * | 9/1980 | Jaramillo et al. | 455/90.3 |
| 2005/0220448 | A1* | 10/2005 | Tei et al. | 396/25 |
| 2010/0247857 | A1* | 9/2010 | Sanami et al. | 428/138 |
| 2011/0013799 | A1* | 1/2011 | Fang et al. | 381/355 |
| 2012/0202559 | A1* | 8/2012 | Shiogama | H04M 1/035 455/550.1 |

* cited by examiner

*Primary Examiner* — Joseph Saunders, Jr.
*Assistant Examiner* — James Mooney
(74) *Attorney, Agent, or Firm* — Steven Reiss

(57) ABSTRACT

A housing assembly of an electronic device includes an outer housing, an inner housing mounted to the outer housing, a first waterproof film positioned between the outer housing and the inner housing, and a second waterproof film spaced from the first waterproof film. The first waterproof film, the outer housing, and the inner housing cooperatively define a first cavity of the housing assembly. The second waterproof film, the inner housing, and the first waterproof film cooperatively form a second cavity of the housing assembly. The first and second waterproof films provide the housing assembly an excellent waterproof property. The electronic device using the housing assembly is also described.

10 Claims, 8 Drawing Sheets

HOUSING ASSEMBLY AND ELECTRONIC DEVICE USING THE SAME

BACKGROUND

1. Technical Field

The present disclosure generally relates to housing assemblies, and particularly to a housing assembly having excellent waterproof property and an electronic device using the housing assembly.

2. Description of Related Art

Electronic devices (such as mobile phones and personal digital assistants) include loudspeakers. Many loudspeakers have an IP67 (Ingress Protection Rating, 6 is a level of protection for solid, 7 is a level of protection for liquid) waterproof film attached to prevent water and/or oil from entering the loudspeaker. However, the IP67 waterproof film is not enough to prevent large amounts of water from penetrating the loudspeaker. Furthermore, the IP67 waterproof film has high acoustic impedance, which reduces a quality of the sound emitted by the loudspeaker.

Therefore, there is room for improvement within the art.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
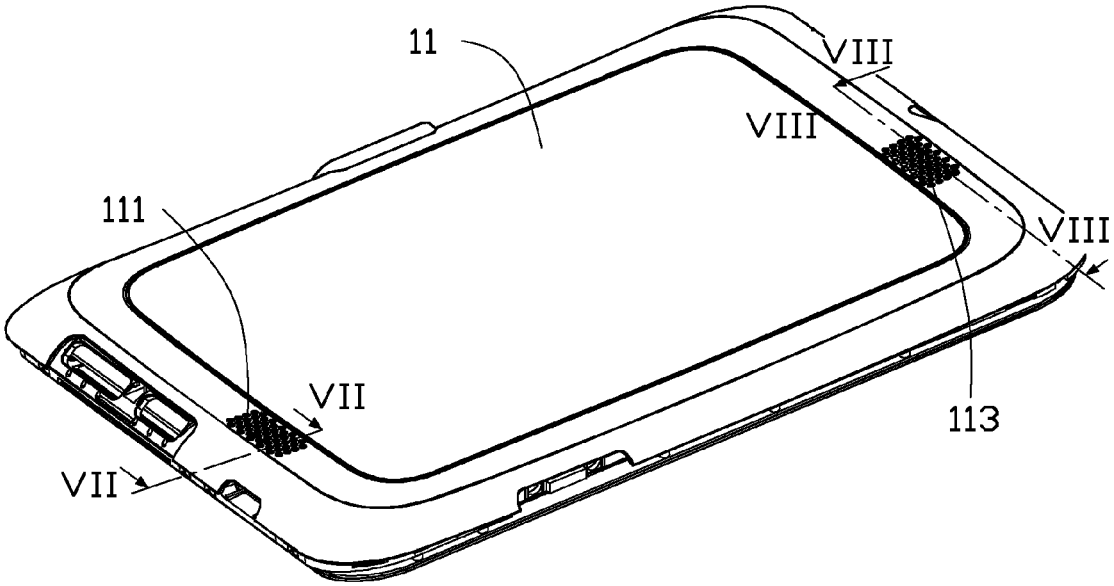
FIG. 1 is a schematic view of an electronic device in accordance with an exemplary embodiment.
Figure 2:
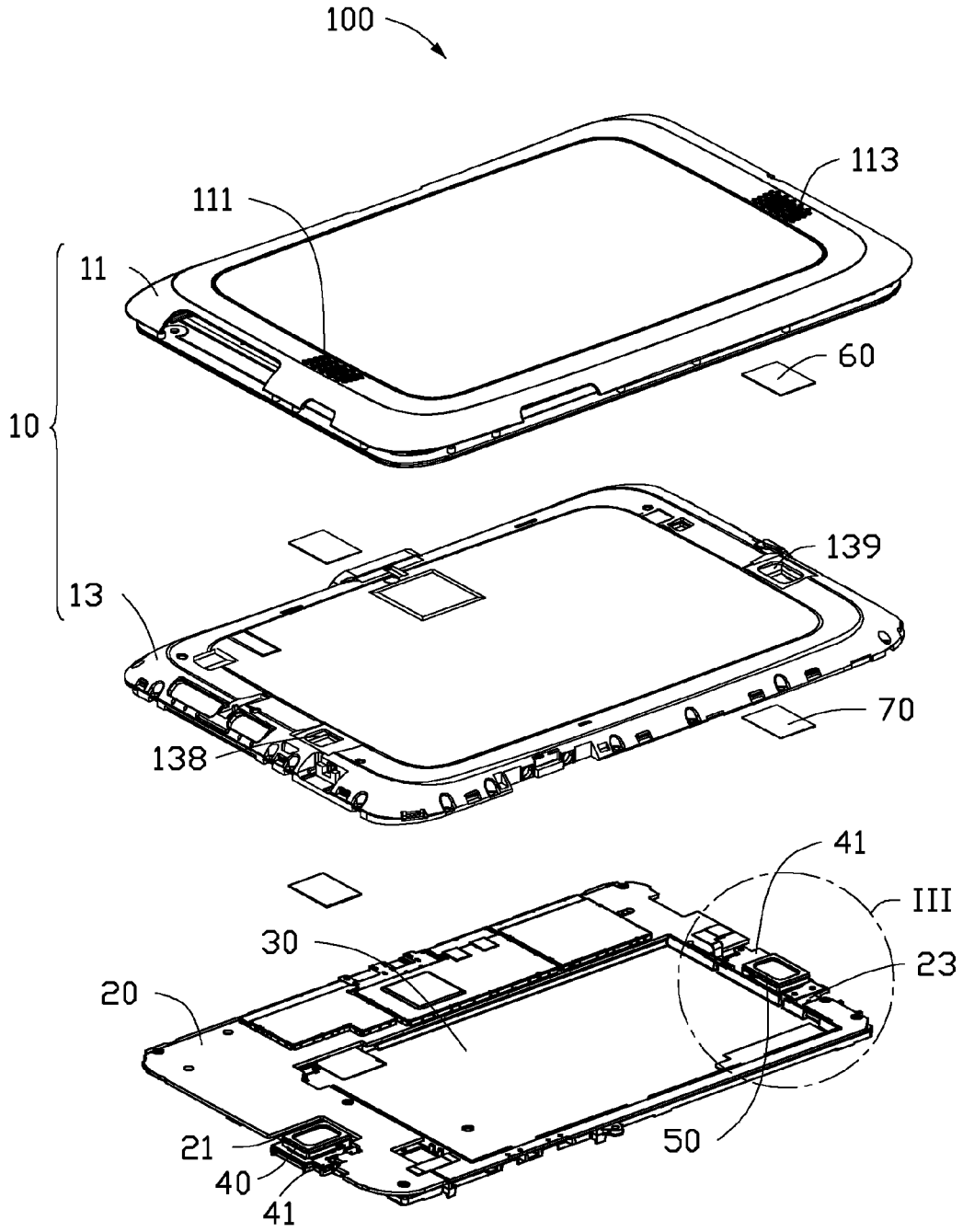
FIG. 2 is an exploded view of the electronic device of FIG. 1.

FIGS. 1-2 show an exemplary embodiment of an electronic device 100 (i.e., a mobile phone) for describing the disclosure. The electronic device 100 includes a housing assembly 10, a circuit board 20, a mounting member 30, a first loudspeaker 40, a second loudspeaker 50, at least one first waterproof film 60, and at least one second waterproof film 70. The circuit board 20 is caught between the housing assembly 10 and the mounting member 30. The first loudspeaker 40 and the second loudspeaker 50 are mounted on the mounting member 30 and are received in the housing assembly 10. The first loudspeaker 40 is positioned at one end of the circuit board 20, while the second loudspeaker 50 is positioned at another end of the circuit board 20. In the exemplary embodiment, there are two first waterproof films 60 and two second waterproof films 70, all of which are received in the housing assembly 10.

The housing assembly 10 may be a rear cover, for example, of the electronic device 100. The electronic device 100 may further include a front cover (not shown) to match the housing assembly 10, and a battery (not shown) connected to the circuit board 20 to power the electronic device 100.

The housing assembly 10 includes an outer housing 11 and an inner housing 13 mounted to the outer housing 11. The outer housing 11 defines a plurality of first sound holes 111 and a plurality of second sound holes 113. The first sound holes 111 are defined at one end of the outer housing 11, while the second sound holes 113 are defined at another end of the outer housing 11. The first sound holes 111 and the second sound holes 113 allow the sounds emitted by the first loudspeaker 40 and the second loudspeaker 50, respectively to transmit to the outside of the housing assembly 10.

Also referring to FIGS. 4-8, the inner housing 13 defines at one end of the inner housing 13 a first receiving chamber 131 and a second receiving chamber 133 adjacent to the first receiving chamber 131. The first receiving chamber 131 and the second receiving chamber 133 communicate with each other via a first through hole 135. The first receiving chamber 131 communicates with the first sound holes 111. The inner housing 13 also defines a third receiving chamber 137 at another end of the inner housing 13. The third receiving chamber 137 communicates with the plurality of second sound holes 113.

Referring to FIGS. 2 and 5-8, two first shoulders 138 protrude from two sidewalls of the first receiving chamber 131. The first shoulders 138 are positioned between the first sound holes 111 and the first loudspeaker 40. Two second shoulders 139 protrude from two sidewalls of the third receiving chamber 137. The second shoulders 139 are positioned between the second sound holes 113 and the second loudspeaker 50.

The circuit board 20 defines a first opening 21 at one end, and a second opening 23 at another end. The first opening 21 corresponds to the first receiving chamber 131 and the first sound holes 111, and the second opening 23 corresponds to the third receiving chamber 137 and the second sound holes 113. The first loudspeaker 40 is received in the first opening 21, and the second loudspeaker 50 is received in the second opening 23.

Figure 3:
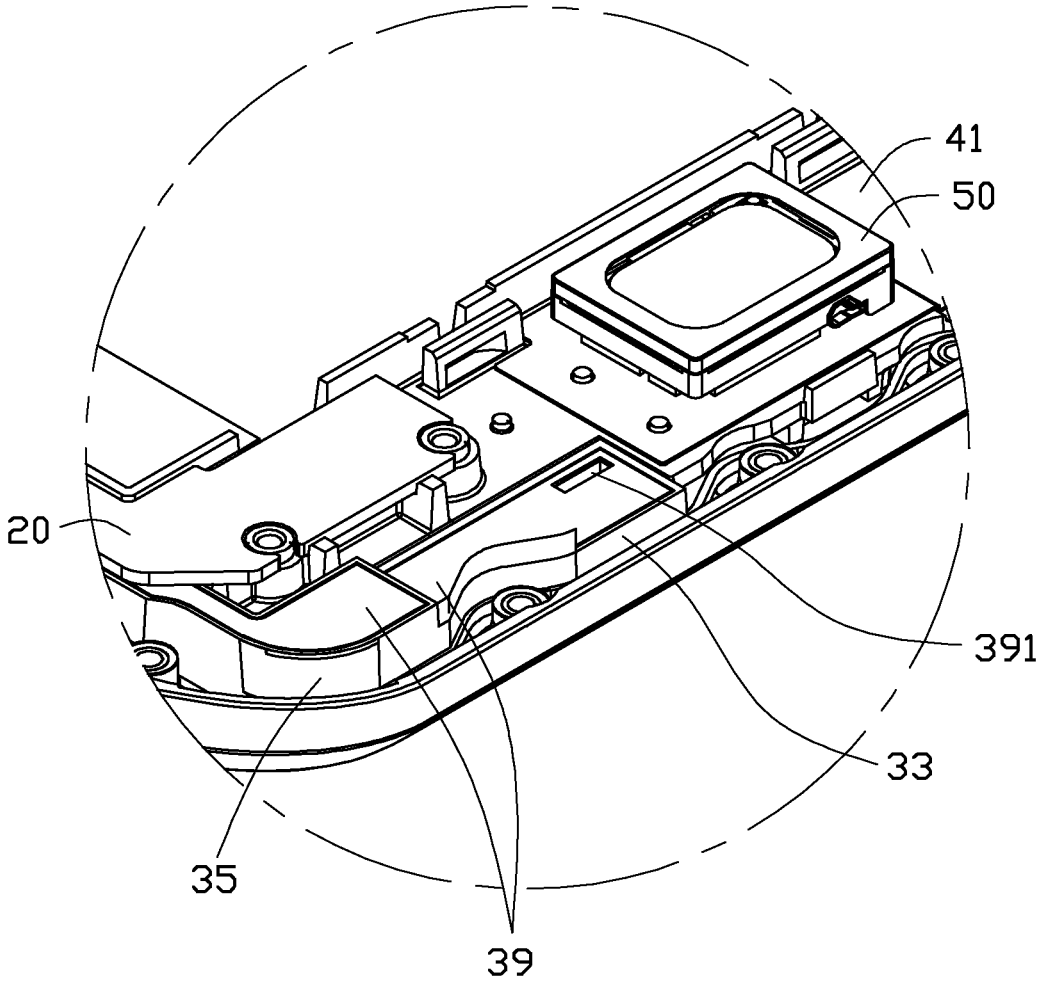
FIG. 3 is an enlarged view of portion III as shown in FIG. 2.
Figure 4:
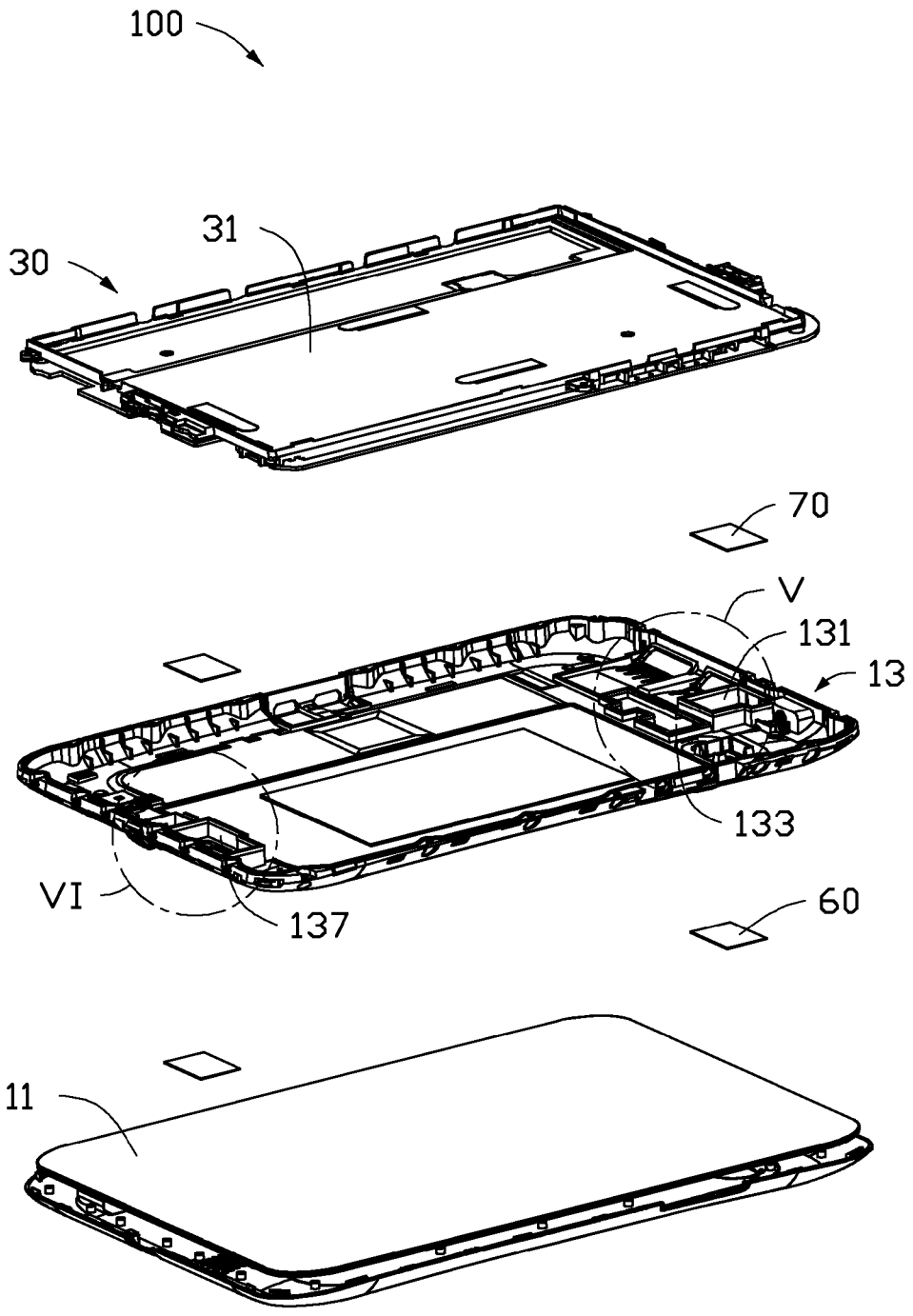
FIG. 4 is another exploded view of the electronic device of FIG. 1.
Figure 5:
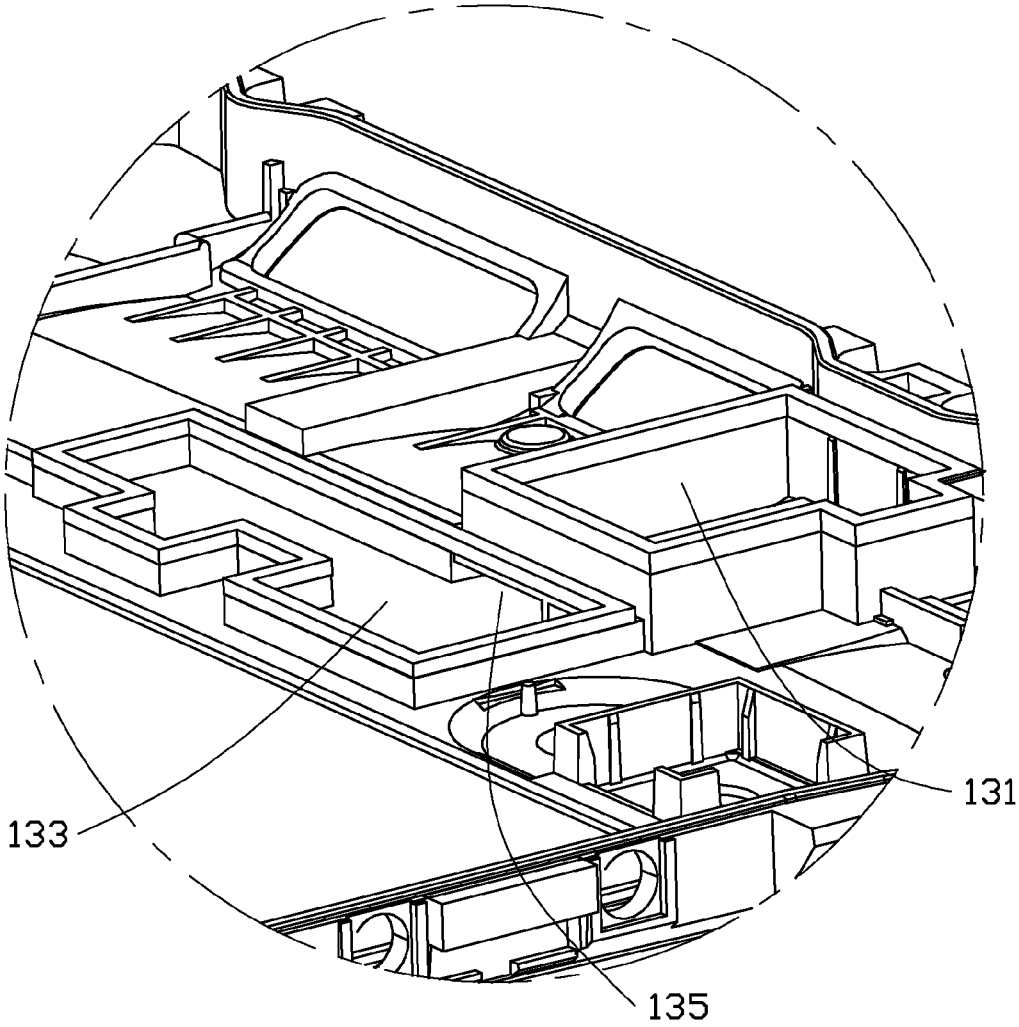
FIG. 5 is an enlarged view of portion V as shown in FIG. 4.
Figure 6:
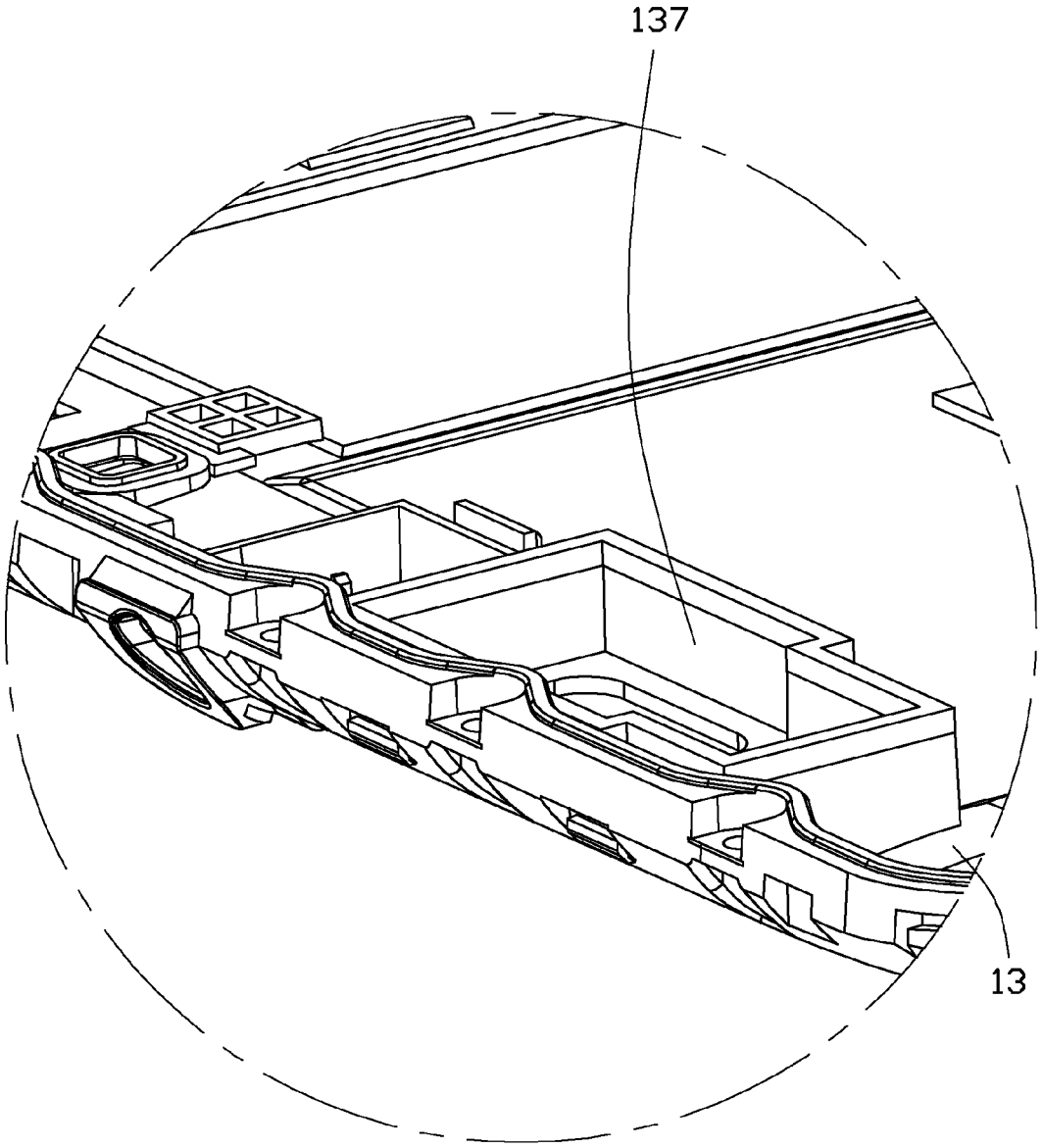
FIG. 6 is an enlarged view of portion VI as shown in FIG. 4.
Figure 8:
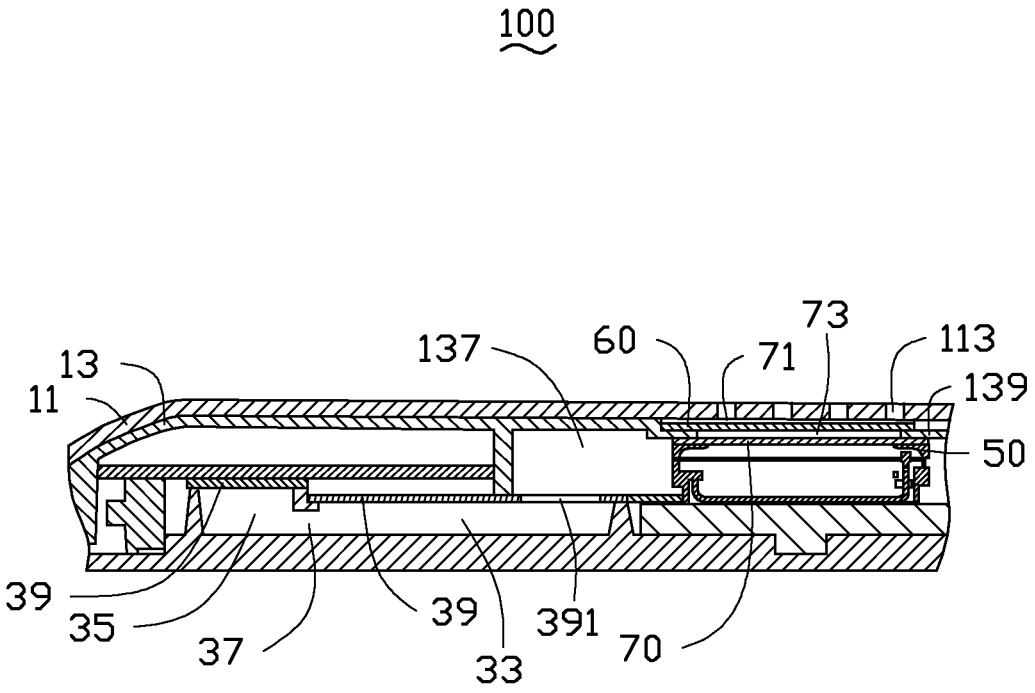
FIG. 8 is a cross-sectional view of the electronic device of FIG. 1 along line VIII-VIII.

Referring to FIGS. 3, 4 and 8, the mounting member 30 includes a bottom wall 31, a first chamber 33 near the second opening 23 of the circuit board 20, and a second chamber 35 adjacent to the first chamber 33. The circuit board 20 is supported by the bottom wall 31. The first chamber 33 and the second chamber 35 communicate via a second through hole 37 (see FIG. 8). The first chamber 33 and the second chamber 35 are each covered by a plate 39. The plates 39 seal the first chamber 33 and the second chamber 35. The plate 39 covering the first chamber 33 defines a third through hole 391. The first chamber 33 and the third receiving chamber 137 communicate via the third through hole 391 (see FIG. 8).

Referring to FIGS. 2 and 3, the first loudspeaker 40 and the second loudspeaker 50 are mounted on the bottom wall 31 of the mounting member 30 via a mounting base 41, which electrically connects the first loudspeaker 40 and the second loudspeaker 50 to the circuit board 20.

Figure 7:
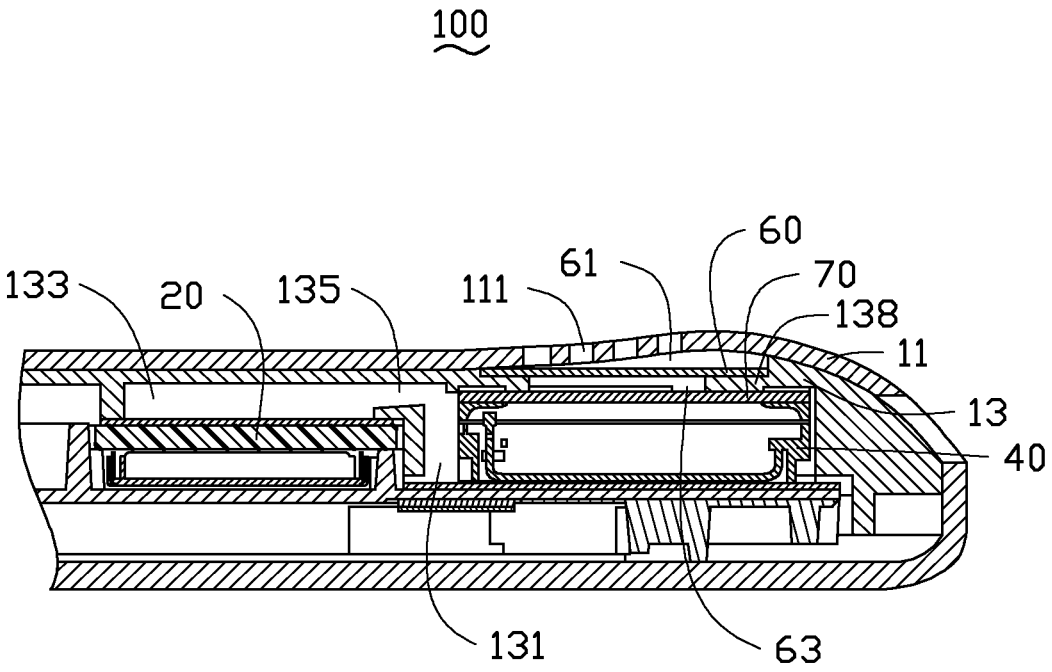
FIG. 7 is a cross-sectional view of the electronic device of FIG. 1 along line VII-VII.

Referring to FIG. 7, one first waterproof film 60 is attached or adhered on the two first shoulders 138. The first waterproof film 60 is positioned between the first shoulders 138 and the outer housing 11, and defines a first cavity 61 with the outer housing 11. One second waterproof film 70 is attached or adhered to the first loudspeaker 40. The second waterproof film 70 is positioned between the first loudspeaker 40 and the two first shoulders 138, and defines a second cavity 63 with the first waterproof film 60 and the first shoulders 138.

Referring to FIG. 8, another first waterproof film 60 is attached or adhered on the two second shoulders 139. The first waterproof film 60 is positioned between the second shoulders 139 and the outer housing 11, and defines a third cavity 71 with the outer housing 11. Another second waterproof film 70 is attached or adhered to the second loudspeaker 50. The second waterproof film 70 is positioned between the second loudspeaker 50 and the two second shoulders 139, and defines a fourth cavity 73 with the first waterproof film 60 and the second shoulders 139.

The waterproof films 60 and 70 are made of synthetic resins or tarp (IP54, for example), which defines a plurality of micro-pores therein (not shown). The waterproof films 60 and 70 protect the loudspeakers 40 and 50 from damage by water, without reducing the quality of the sound. Since there are two waterproof films for each loudspeaker, the waterproof property of the loudspeakers 40 and 50 is enhanced. Even if water manages to penetrate the first waterproof films 60 to enter in the second cavity 63 and the fourth cavity 73, the water cannot penetrate the second waterproof films 70. Furthermore, when the first and second loudspeakers 40 and 50 are turned on, water in the second cavity 63 and the fourth cavity 73 is discharged out of the outer housing 11 by the vibration of the first and second loudspeakers 40 and 50.

During assembly of the electronic device 100, the circuit board 20 is mounted to the bottom wall 31 of the mounting member 30. The two mounting bases 41 are mounted on the bottom wall 31 of the mounting member 30 at a location corresponding to the first opening 21 and the second opening 23, respectively, and are electrically connected to the circuit board 20. The first loudspeaker 40 covered by one second waterproof film 70 and the second loudspeaker 50 covered by another second waterproof film 70 are respectively mounted to one of the mounting bases 41. One first waterproof film 60 is adhered to the first shoulders 138, and another first waterproof film 60 is adhered to the second shoulders 139. The inner housing 13 is engaged with the outer housing 11 to form the housing assembly 10. Then, the housing assembly 10 is engaged with the mounting member 30. As such, the first loudspeaker 40 is received in the first receiving chamber 131, and the second loudspeaker 50 is received in the third receiving chamber 137.

It is believed that the exemplary embodiment and its advantages will be understood from the foregoing description, and it will be apparent that various changes may be made thereto without departing from the spirit and scope of the disclosure or sacrificing all of its advantages, the examples hereinbefore described merely being preferred or exemplary embodiment of the disclosure.

What is claimed is:

1. An electronic device, comprising:

a housing assembly, the housing assembly comprising an outer housing, an inner housing mounted to the outer housing, and a first waterproof film positioned between the outer housing and the inner housing to define a first cavity with the outer housing and the inner housing;

a first loudspeaker received in the housing assembly;

a second waterproof film attached to the first loudspeaker and spaced from the first waterproof film, the second waterproof film positioned between the inner housing and the first loudspeaker, wherein the second waterproof film, the inner housing, and the first waterproof film cooperatively form a second cavity;

a mounting member mounted to the housing assembly, wherein the mounting member comprises a bottom wall, a first chamber, and a second chamber adjacent to the first chamber, the first chamber and the second chamber in air communication with each other; and two plates, wherein one of the two plates covers the first chamber and the other of the two plates covers the second chamber, wherein the first chamber and the second chamber together define a space between the two plates and the bottom wall of the mounting member;

wherein the inner housing comprises a first receiving chamber, two first shoulders protrude from two sidewalls of the first receiving chamber, each of the two first shoulders comprises a top surface and a bottom surface opposite to the top surface, the first waterproof film is attached on the top surface of the first shoulders, the first waterproof film is positioned between the first shoulders and the outer housing so as to define the first cavity; the second waterproof film is attached on the bottom surface of the first shoulders, the two first shoulders are sandwiched between the first waterproof film and the second waterproof film; and wherein the first waterproof film, the second waterproof film, and the two first shoulders cooperatively form the second cavity.

2. The electronic device of claim 1, wherein the outer housing defines a plurality of first sound holes at one end of the outer housing, the first waterproof film faces the first sound holes, the second waterproof film is attached on a side of the first loudspeaker facing towards the first sound holes.

3. The electronic of claim 2, wherein the first receiving chamber is positioned at one end of the inner housing facing towards the outer housing and is in air communication and coupled with the plurality of first sound holes.

4. The electronic device of claim 1, wherein the outer housing defines a plurality of second sound holes at another end of the outer housing, the electronic device comprises another first waterproof film corresponding to the second sound holes, the another first waterproof film faces the second sound holes, the another first waterproof film is positioned between the inner housing and the outer housing so as to define a third cavity.

5. The electronic device of claim 4, wherein the electronic device comprises another second waterproof film facing the another first waterproof film, and a second loudspeaker received in the housing assembly, wherein the another second waterproof film is attached on the second loudspeaker, the another first waterproof film, the inner housing, and the another second waterproof film cooperatively forming a fourth cavity.

6. The electronic of claim 5, wherein the first and second loudspeakers are mounted on the mounting member by two mounting bases.

7. The electronic of claim 5, wherein the first and second waterproof films are made of synthetic resin or tarp, the first and second waterproof films define a plurality of micro-pores therein.

8. The electronic of claim 4, wherein the inner housing defines a second receiving chamber adjacent to the first receiving chamber and a third receiving chamber at another end of the inner housing facing towards the outer housing and in air communication and coupled with the plurality of second sound holes, the first receiving chamber and the second receiving chamber are in air communication and coupled to each other via a first through hole, two second shoulders protrude from two sidewalls of the third receiving chamber facing the second sound holes, the another first waterproof film is attached on the second shoulders, the another first waterproof film is positioned between the second shoulders and the outer housing so as to define the third cavity.

9. The electronic of claim 8, wherein the plate covering the first chamber defines a through hole, and the first chamber and the third receiving chamber are in air communication and coupled through the through hole.

10. The electronic of claim 1, wherein the electronic device comprises a circuit board caught between the inner housing and the mounting member, the circuit board is supported by the bottom wall, and the circuit board defines a first opening and a second opening at the two opposite ends of the circuit board, the first loudspeaker is received in the first opening, and the second loudspeaker is received in the second opening.

* * * * *